US005378188A

United States Patent [19]

Clark

[11] Patent Number: 5,378,188

[45] Date of Patent: Jan. 3, 1995

[54] TENDON AND SPRING FOR TOY ACTUATION

[76] Inventor: Dolores H. Clark, P.O. Box 145, Crystal River, Fla. 34423

[21] Appl. No.: 133,572

[22] Filed: Oct. 8, 1993

[51] Int. Cl.[6] ..... A63H 3/20; A63H 19/00

[52] U.S. Cl. ..... 446/330; 446/361; 446/365; 446/490

[58] Field of Search ..... 446/330, 331, 268, 278, 446/320, 337, 338, 339, 340, 352, 353, 354, 356, 359, 361, 365, 371, 376, 382, 368, 490

[56] References Cited

U.S. PATENT DOCUMENTS

| | | | |
|---|---|---|---|
| 957,819 | 5/1910 | Ulbrich | 446/337 X |
| 1,063,403 | 6/1913 | Whitehouse . | |
| 2,158,860 | 5/1939 | Hyde | 446/338 X |
| 2,614,365 | 10/1952 | Musselwhite et al. . | |
| 3,053,008 | 9/1962 | Pelunis . | |
| 3,125,828 | 3/1964 | Ostrander . | |
| 3,358,401 | 12/1967 | Graf | 446/331 |
| 3,713,252 | 1/1973 | Bear et al. | 446/365 |
| 3,724,125 | 4/1973 | Goldfarb et al. . | |
| 3,928,933 | 12/1975 | Iwamoto . | |
| 4,393,728 | 7/1983 | Larson et al. | 446/320 X |
| 4,571,208 | 2/1986 | Saigo et al. | 446/353 |
| 4,575,349 | 3/1986 | Piazza et al. | 446/330 |
| 4,601,671 | 7/1986 | Demars . | |
| 4,666,419 | 5/1987 | Droller et al. | 446/330 |
| 4,815,911 | 3/1989 | Bengtssen et al. | 446/368 X |

FOREIGN PATENT DOCUMENTS

| | | | |
|---|---|---|---|
| 608513 | 7/1926 | France | 446/382 |
| 1042944 | 11/1953 | France . | |
| 541785 | 4/1956 | Italy | 446/339 |
| 139849 | 3/1953 | Sweden | 446/330 |
| 1437654 | 6/1976 | United Kingdom | 446/365 |
| 2081111 | 2/1982 | United Kingdom | 446/331 |

*Primary Examiner*—Robert A. Hafer
*Assistant Examiner*—D. Neal Muir
*Attorney, Agent, or Firm*—Pettis & McDonald

[57] ABSTRACT

This invention relates to a mechanism for animating toy figures, including stuffed animals and dolls. The actuating mechanism includes at least two resiliently deflectable elements that are connected at respective first and second ends so that by urging the first ends toward the second ends the deflectable elements deflect and the middle portion of each element moves away from the middle portion of the other element. The first end of one of at least two tendons is attached to the middle portion of a deflectable element and the first end of the other tendon is attached to the middle portion of the other deflectable element so that a portion of each tendon including the second end extends beyond the opposing deflectable element and when the elements are deflected they pull the first and second tendons past one another and urge the second ends of the tendons toward the deflectable elements.

16 Claims, 5 Drawing Sheets

TENDON AND SPRING FOR TOY ACTUATION

BACKGROUND OF THE INVENTION

1. Field of the Invention

This invention relates to a mechanism for animating toy figures, including large stuffed animals and dolls. The mechanism is capable of various simultaneous movements of a plurality of appendages.

2. Description of the Prior Art

Toys that have moving parts are well known in the art. Particularly, dolls that have moveable arms and legs. The mechanisms used to animate the dolls vary from elastic cords to springs and levers. For example, U.S. Pat. No. 3,724,125 issued to Goldfarb et al., uses cords attached to one end of each limb to provide a wiggling movement of the limbs when a button is pushed. Also, U.S. Pat. No. 4,601,671, issued to DeMars, and U.S. Pat. No. 3,053,008, issued to Pelunis, use levers to provide a hugging motion when a central mechanism is squeezed. U.S. Pat. No. 1,063,403, issued to Whitehouse, discloses a spring and lever mechanism to move the eyes of a doll.

In the prior art the movements of the parts of the dolls are relatively limited, being restricted to relatively simple movements. It is clear that there remains a need for a mechanism that will provide various types of activity through a relatively wide range of movement to provide toys that are interactive and provide a wide range of action to gain and maintain the interest of children.

SUMMARY OF THE INVENTION

The current invention is a simple mechanism that creates movement within the various parts of toys or dolls to create such activities as hugging, clapping, waving and so forth. Most simply stated, the actuating mechanism of the invention is comprised of at least two resiliently deflectable elements, a first element and a second element, each of which have a first end and a second end. The first ends of each element are connected to one another and the second ends are also connected to one another. When a force is applied proximal to the first ends and a second opposing force is applied proximal to the second ends, directed so that the first ends and second ends are urged toward one another, the forces will cause the deflectable elements to deflect. The deflectable elements are oriented in relation to one another so that their deflection will cause portions of each of the elements that are intermediate the first and second ends to be deflected away from one another. The mechanism further comprises at least two tendons, a first and a second tendon, each tendon having a first end and a second end. The first end of the first tendon is connected to the first deflectable element so that a portion of the first tendon including the second end, extends past the deflectable element. The first end of the second tendon is then connected to the second deflectable element in similar fashion. It is attached intermediate the first end and the second end of the second deflectable element so that a portion of the second tendon, including the second end, extends past the first deflectable element. Therefore, when the deflectable elements are deflected, each deflectable element will pull the attached tendon so that the tendons are moved past one another in generally opposite directions pulling the seconds ends of each of the tendons toward the deflectable elements.

BRIEF DESCRIPTION OF THE DRAWINGS

A preferred embodiment of the apparatus of this invention will be disclosed in detail in which.

DESCRIPTION OF A PREFERRED EMBODIMENT

The actuating mechanism of this invention may be included in many different types of toys or devices with the deflectable elements and tendons operatively connected to various operating parts of the toys. The mechanism itself, generally indicated as 10 in FIGS. 1–4, is comprised of at least two resiliently deflectable elements, a first element 12 and a second element 14, and at least two tendons, a first tendon 16 and a second tendon 18.

Figure 1:
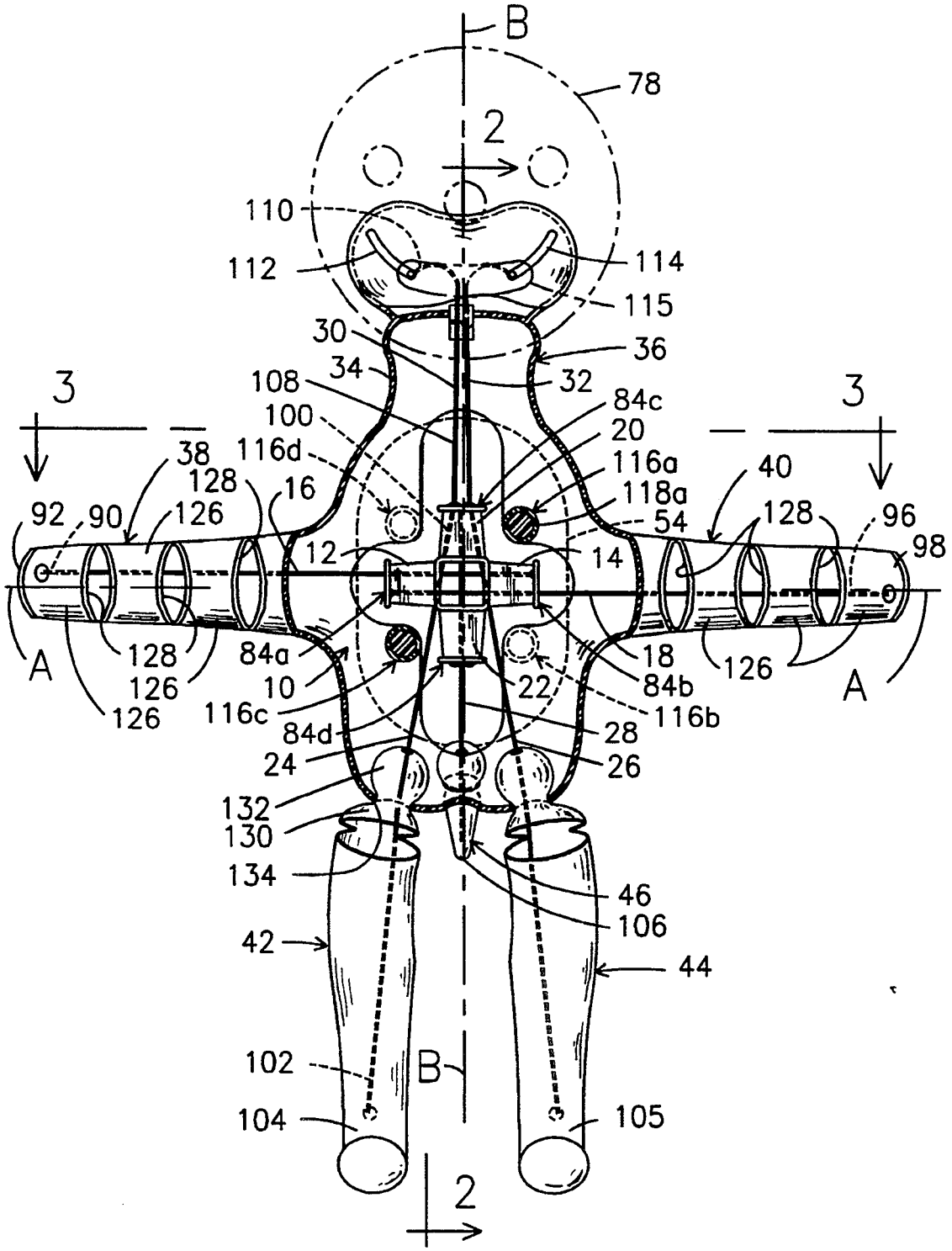
FIG. 1 is a front elevational view of the actuating mechanism inserted within a toy, a portion of the mechanism and toy being broken away.

In one embodiment, as shown in drawing FIGS. 1–4, the actuating mechanism comprises four resiliently deflectable elements, including the first deflectable element 12, the second deflectable element 14 and two additional deflectable elements defined as a third deflectable element 20 and a fourth deflectable element 22. FIGS. 1–4 also illustrate in this embodiment a total of seven tendons, including the first tendon 16 and the second tendon 18. In addition to those tendons the embodiment includes a third tendon 24, a fourth tendon 26, a fifth tendon 28, a sixth tendon 30 and a seventh tendon 32. As shown in FIG. 1 the mechanism 10 is attached to the body 34 of a toy, shown generally as 36, that has five appendages attached thereto. The five appendages comprise a first appendage 38 and a second appendage 40 that define opposing arms, a third appendage 42 and a fourth appendage 44 that define a pair of legs, and a fifth appendage 46, defining a tail. In other embodiments, other appendages and other groupings of appendages and operating elements may be used such as a pair of eyes, more than four legs, a nose, a mouth and so forth.

Figure 2:
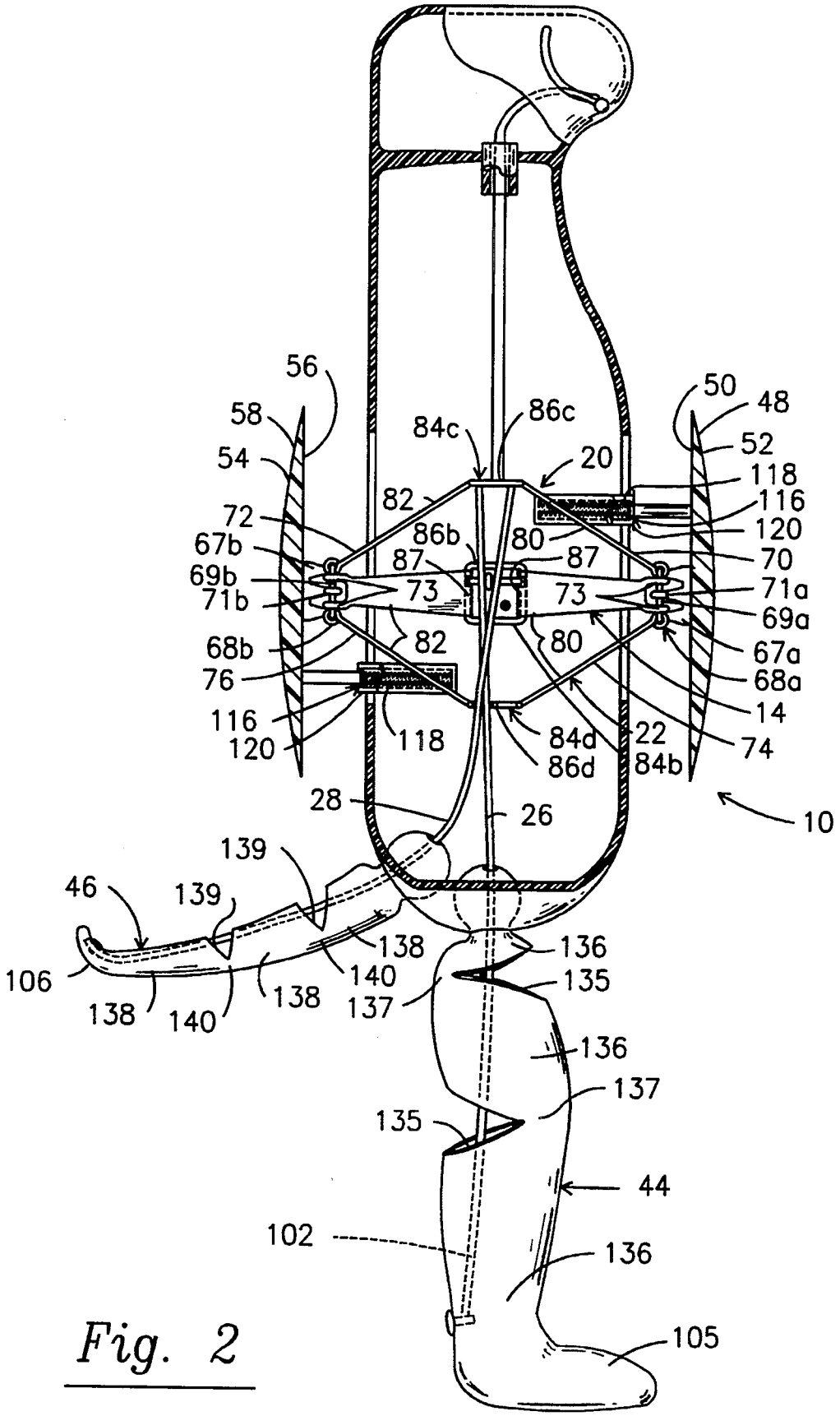
FIG. 2 is a cross sectional view of the invention of FIG. 1 taken along line 2—2.
Figure 3:
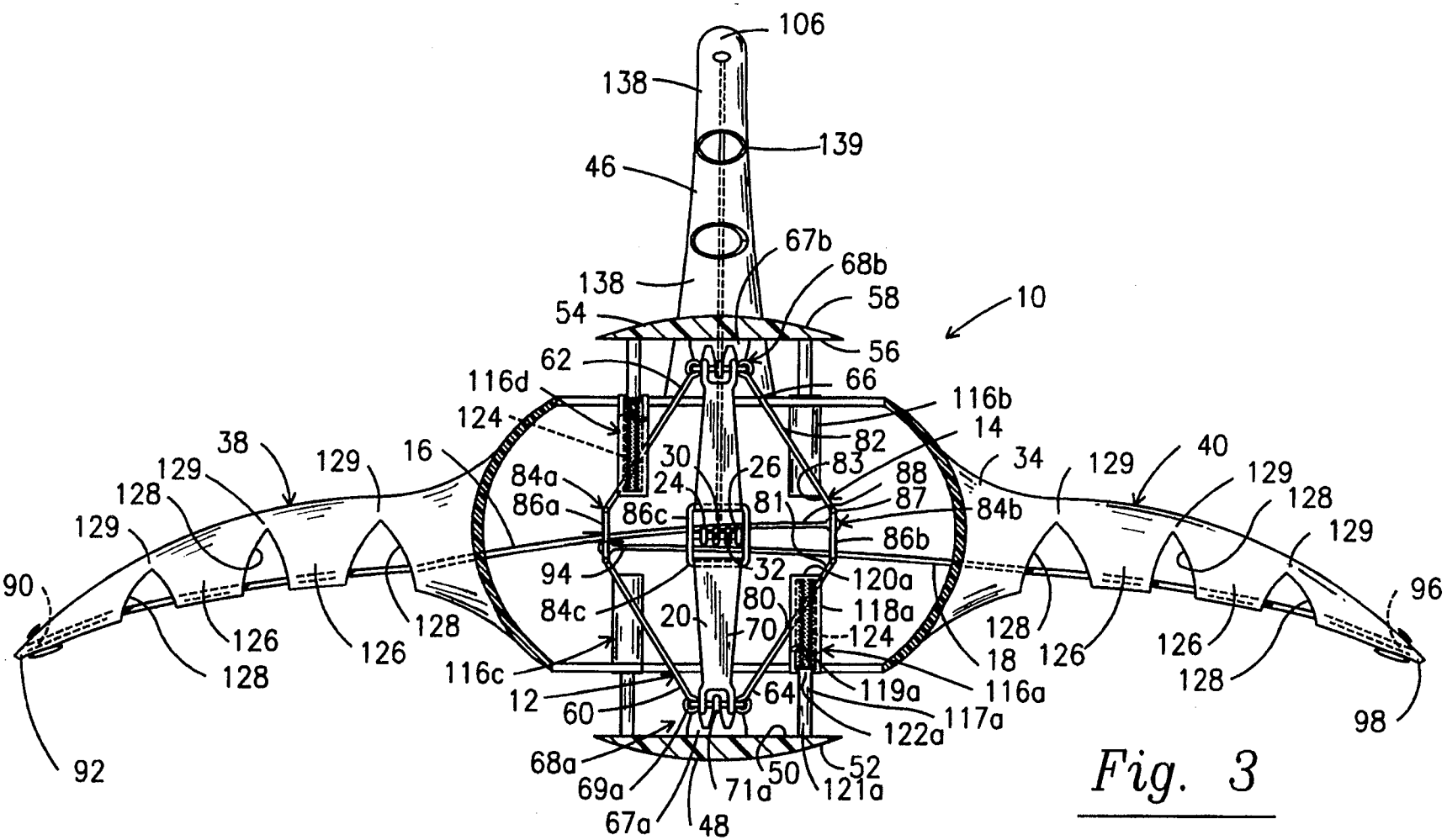
FIG. 3 is a cross sectional view of the invention of FIG. 1 taken along line 3—3.

Referring first to FIG. 2, it can be seen that the mechanism comprises a front compression plate 48 having an inward side 50 and an outward side 52 and a back compression plate 54 that has an inward side 56 and an outward side 58. As best seen in FIG. 3, the first deflectable element 12 has a first end 60 and a second end 62. The second deflectable element 14 has a first end 64 and a second end 66. The first end 60 of the first deflectable element 12 is connected to the first end 64 of the second deflectable element 14, as both first ends 60 and 64 are hingedly attached to the inward side 50 of the front compression plate 48. In the same fashion, the second end 62 of the first element 12 is connected to the second end 66 of the second deflectable element 14, as both seconds ends 62 and 66 are hingedly attached to the inward side 56 of the back compression plate 54. The hinge means 68 for attaching the ends of each deflectable element to a respective compression plate may be any standard hinge device allowing free movement of the deflectable elements in relation to the compression plates. In this embodiment, as shown in FIG. 2, hinge means 68*a* comprises a connector 67*a* that is attached to the inward side 50 of compression plate 48 and a rectangular loop 69*a*. Connector 67*a* comprises four connector hooks 71*a* spaced about the four sides of the rectangular loop 69*a* so that they extend away from the inward side 50 of compression plate 48. Each of the ends of the deflectable elements 12 and 14 have a pair of element hooks 73 formed thereon for attachment to the rectangular loop 69*a*. The hinge means 68*a* permits the ends 60 and 64 of the deflectable elements to be attached to compression plate 48 and yet freely pivot in relation to compression plate 48. In similar fashion, a hinge means 68*b* is attached to the inward side 56 of the rear compression plate 54 for attachment of the element hooks 73 on each of the second ends 62 and 66 of the respective deflectable elements 12 and 14. As shown in FIG. 1, first deflectable element 12 and the second deflectable element 14 are oriented generally parallel with an axis A extending from the first appendage 38 through the body 34 and through the second appendage 40.

In FIG. 1 it can be seen that the third deflectable element 20 and the fourth deflectable element 22 are longitudinally aligned generally parallel with the longitudinal axis B of the toy 36, the axis extending through the center of the head 78, which is shown in phantom, and the center of the body 36. As best seen in FIG. 2, the third deflectable element 20 has a first end 70 and a second end 72 and the fourth deflectable element 22 has a first end 74 and a second end 76. The first ends 70 and 74 of the respective elements 20 and 22 are hingedly attached to hinge means 68*a* and the second ends 72 and 76 are hingedly attached to hinge means 68*b* in the same fashion as the first deflectable element 12 and the second deflectable element 14.

In a preferred embodiment, the resilient deflectable element 14, as seen in FIG. 3, is comprised of a first part 80 that includes the first end 64 of deflectable element 14 and a second part 82 that includes the second end 66 of the deflectable element 14. Therefore, part 80 of the deflectable element 14 has a first end 64 and a second end 81, and part 82 of the deflectable element 14, has a first end 83 and a second end 66. Second end 81 of part 80 and first end 83 of part 82 are attached to opposing sides of joint means 84*b*. As seen in FIGS. 1 and 2, the joint means 84*b* comprises a rectangular ring 86*b* and ends 81 and 83 have curved portions 87 thereon that are pivotally attached to the ring 86*b*. In other embodiments, the joint means 84*b* may comprise a pin hinge or a weakened portion in a continuous element. In still other embodiments, the deflectable elements may be continuous and flexible without a hinge joint. Deflectable elements 12, 20 and 22 are similarly divided into two parts that are attached to one another by a similar joint means 84*a*, 84*c* and 84*d*, respectively.

As seen in FIG. 3, the first end 88 of the first tendon 16 is attached to the joint means 84*b*. The second end 90 of the tendon 16 extends through the joint means 84*a* of the first deflectable element 12 so that a portion of the tendon extends past the deflectable element 12 and is connected to the end 92 of the first appendage 38. Similarly, the first end 94 of the second tendon 18 is connected to the joint means 84*a* of the first deflectable element 12 so that the second and 96 extends through the joint means 84*b* of the second element 14 so that a portion of the second tendon 18 extends past the second deflectable element 14 and connects with the end 98 of the second appendage 40.

The third tendon 24, as seen in FIG. 1, has a first end 100 and a second end 102. The first end 100 is attached to the joint means 84*c* of the third deflectable element 20 and the second end extends past the fourth deflectable element 22 so that the second end 102 is attached to the first end 104 of the third appendage 42. The fourth tendon 26 is similarly attached to the third deflectable element 20 and to the first end 105 of the fourth appendage 44. The fifth tendon 28 is also similarly attached to the third deflectable element 20 and to the first end 106 of the fifth appendage 46.

The first end 108 of the sixth tendon 30 is attached to the joint means 84*c* of the third element 20 so that the second end 110 of the sixth tendon 30 extends away from the third deflectable element 20 and the fourth deflectable element 22. The head area 78 of the body 34 of the toy 36 comprises a pair of curved openings 112 and 114. The second end 110 of the sixth tendon 30 extends through the opening 112 so that it may be attached to the flexible exterior surface (not shown) of the toy 36. In this case, it is attached to one corner of a mouth 115 shown in phantom that is in the exterior surface (not shown). The seventh tendon 32 is similarly attached to the third deflectable element 20 and to the other opening 114 so that it may be attached to the opposing corner of the mouth 115.

As shown in FIGS. 2 and 3, a plurality of stabilizers 116, in this embodiment four, are provided to resiliently stabilize the front compression plate 48 and the back compression plate 54 in relation to the body 34. Each stabilizer 116 comprises a post 117 that is attached to the adjacent compression plate 48 or 54 and a tube 118 that is attached to the body 34. Each tube 118 has a first open end 120 that is attached to the body 34 of the doll 36. As seen in FIG. 1, the stabilizers are spaced evenly to maintain proper alignment between the compression plates 48 and 54 and the body 34 of the toy 36. As seen in FIG. 3 a stabilizer, for example stabilizer 116*a*, comprises a post 117*a* and a tube 118*a*. The first end 119*a* of the tube 118*a* is open and is attached to the body 34 and the second end 120*a* is closed. In other embodiments the tube 118*a* may be formed integrally with the body 34. The post 117*a* has a first end 121*a* which is attached to the front compression plate 48 and a second end 122*a* that is received within the open end 119*a* of the tube 118*a*. Stabilizers 116*a* and 116*c* are attached to the front compression plate 48 and the body 34 of the doll 36 and stabilizers 116*b* and 116*d* are attached to the rear compression plate 54 and the body 34 of the doll 36.

By applying a force to the outward side 52 of compression plate 48 and to the outward side 58 of compression plate 54 the compression plates may be moved toward one another forcing the posts 117 of each stabilizer 116 to slide into the respective tube 118. A biasing means, conveniently compression spring 124, is inserted within at least one of the tubes 118 between the second end 122 of the posts 117 and the second end 120 of the tube 118 of the stabilizers 116 so that the back compression plate 54 and the front compression plate 48 are urged away from one another. In this embodiment a spring 124 is inserted in each stabilizer 116. In other embodiments the biasing means may comprise a tension spring extending between the first deflectable element 12 and the second deflectable element 14 and/or between the third and fourth deflectable elements 20 and 22.

In the illustrated embodiment shown in FIGS. 1 and 3, each of the arms, first appendage 38 and second appendage 40, comprises a plurality of segments 126 that are separated by a plurality of v-shaped arm apertures 128. In this embodiment, the portion of the appendage opposite the v-shaped arm aperture 128 is weakened to form a segment hinge 129. In other embodiments a standard leaf hinge or other well-known hinges suitable for the purpose may be used. The arms 38 and 40 are contiguously attached to the body 34 of the toy 36.

As shown in FIG. 1, the second end 130 of the third appendage 42 has a ball 132 formed thereon that is insertable in a hole 134 through the body 34 permitting the leg 42 to rotate about its second end 130 a well known ball and socket joint. The fourth appendage 44 and the fifth appendage 46 are similarly attached to the body 34. Leg 42 and leg 44 each comprise three sections 136, as best seen in FIG. 2, to permit the legs 42 and 44 to bend. The sections 136 are separated from one another by v-shaped leg apertures 135 similar to the arm apertures 128. The portion of the wall opposing each of the leg apertures 135 is weakened to form a leg hinge 137 permitting the legs 42 and 44 to bend. The tail 46 is subdivided into parts 138 that are separated from one another by v-shaped tail apertures 139 and opposing weakened wall portions forming tail hinges 140, similar to the arms 38 and 40 and the legs 42 and 44.

Figure 5:
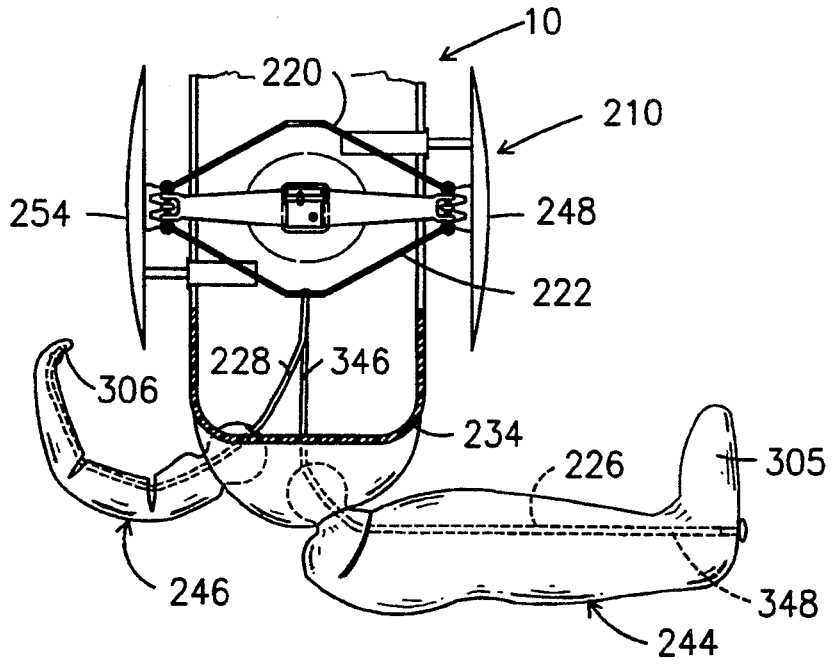
FIG. 5 is a partial left side elevational view of a second embodiment of the mechanism.
Figure 6:
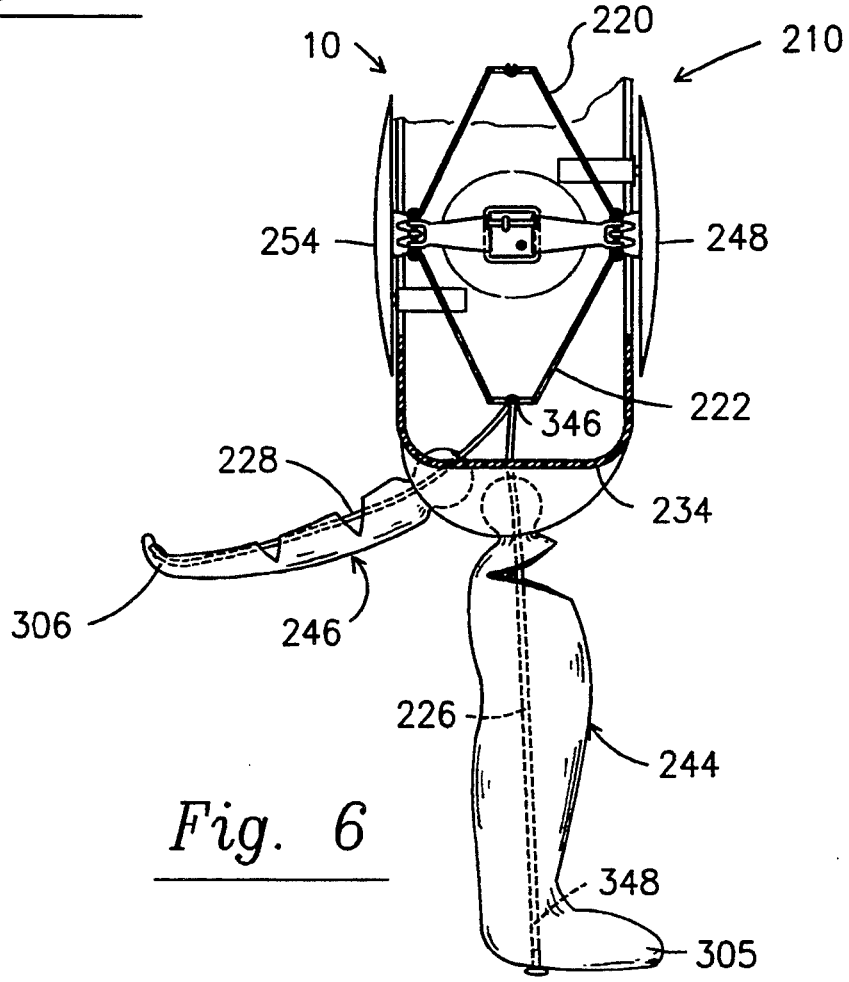
FIG. 6 is a partial left side elevational view of the embodiment of FIG. 5 illustrating the deflection of the deflectable elements.

FIGS. 5 and 6 disclose a second embodiment of the invention in which the mechanism 210 and the body 234 of the toy are formed as previously described with the exception of the attachment of the tendons for the operation of the legs and tail. The second embodiment utilizes reference numbers that have been increased by an increment of 200 for the structure that is the same as the first embodiment. In the second embodiment, the tendons operating the third appendage (not shown) and the fourth appendage 224 may be defined as a third tendon (not shown) and a fourth tendon 226. Tendon 226 has a first end 346 that is attached to the fourth deflectable element 222. The second end 348 of the fourth tendon 226 extends away from the fourth deflectable element 222 and away from the third deflectable element 220 so that the tendon 226 may be attached to the first end 305 of the appendage 244. In the same fashion, the fifth tendon 228 may be attached to the fourth deflectable element 222 and the first end 306 of the fifth appendage 246. In this embodiment, as shown in FIG. 5, when the compression plates are not compressed the tendons of the legs are under tension holding the legs in a sitting position and the tail in a curled position. As shown in FIG. 6, when the compression plates 248 and 254 are moved toward one another the tendons 226 and 228 relax so that the appendages hang loosely.

In a preferred embodiment most of the parts of the apparatus are molded from well known synthetic resins suitable for the purpose. The springs may be constructed of spring steel for durability. The tendons may be braided nylon or stiff synthetic resin depending on whether the tendons are pulling or pushing.

Figure 4:
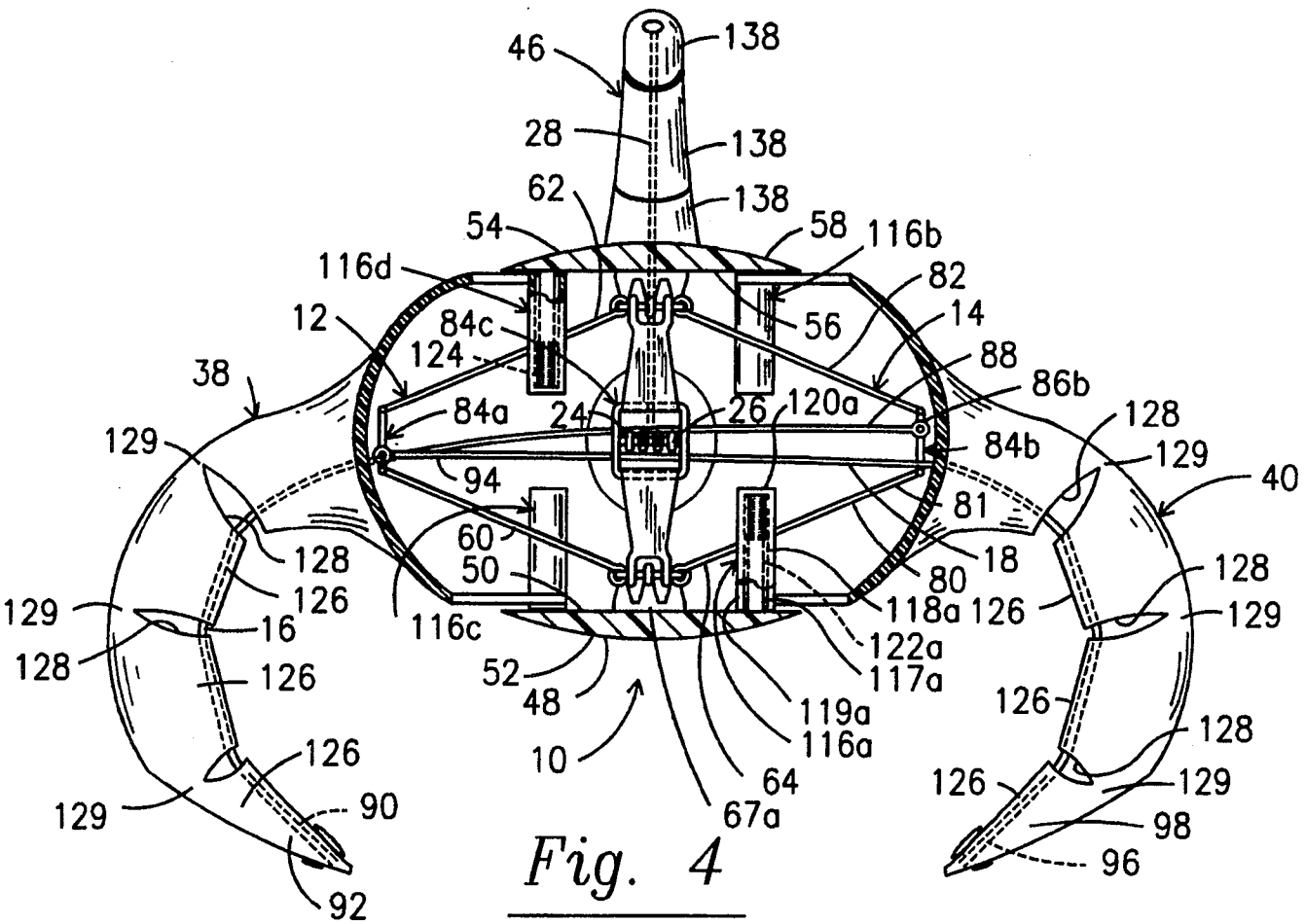
FIG. 4 is the cross sectional view of the invention of FIG. 3, illustrating the deflection of the deflectable elements of the invention.

With the preferred embodiments of the apparatus of this invention having been described in detail above, the operation may now be described. As best seen in FIGS. 3 and 4, when pressure is applied to the outward side 52 of compression plate 48 and an opposing force is applied to the outward side 58 of the back compression plate 54, the post 117 of each stabilizer 116 is moved inwardly into its respective tube 118 compressing the spring 124 therein and each deflectable element 12, 14, 20 and 22 are deflected so that the joint means 84 that is intermediate the first and second ends of each deflectable element, 12, 14, 20 and 22 are deflected away from one another. As the deflectable element 14 is deflected the second end 90 of tendon 16 is pulled inwardly toward the first deflectable element 12 causing the second end 92 of the first appendage arm 38 to also move inwardly so that the arm 38 bends at the v-shaped arm apertures 128 and the first appendage 38 becomes curved as shown in FIG. 4. Similarly, the second end 96 of tendon 18 is pulled inwardly causing the second end 98 of the second appendage, arm 40 to form a curve as shown in FIG. 4. Therefore, as a child hugs the toy 36 the opposing compression plates 48 and 54 are moved toward one another causing the arms 38 and 40 to curl about the child's body giving the child a hug. In the same fashion, the ends 104 and 105 of the third and fourth appendages, legs 42 and 44, are moved inwardly toward the body 34 of the toy 36 causing the legs 42 and 44 to bend and pull upward toward the body. Also, tendon 28 is pulled causing the fifth appendage 46 or tail to curl.

As the joint means 84 of the third deflectable element 20 is deflected and moves away from the other deflectable elements 12, 14 and 22, the second end 110 of tendon 30 is pushed outwardly so that it moves along the opening 112. As the seventh tendon 32 moves similarly to the sixth tendon 30, both sides of the mouth 115 of the toy 36 are moved away from axis B creating a smile while the toy is being hugged. When the child stops hugging the toy 36 the springs 124 move the opposing front compression plate 48 and back compression plate 54 away from one another so that each of the appendages returns to the original or relaxed position.

In the second embodiment the left leg 244 and the right leg (not shown) of the doll are under tension and are held in a sitting position and the tail 246 in a curled position. As the doll is hugged the tail and legs relax hanging down loosely.

While the foregoing description is directed to particularly preferred embodiments of the present invention, it is to be understood that these embodiments are representative only of the principle of the invention and are not to be considered limitative thereof. Because numerous variations and modifications of both the apparatus and the method, all within the scope of the present invention, will become apparent to those skilled in the art, the scope of the invention is to be limited solely by the claims appended hereto.

What is claimed is:

1. An actuating mechanism for a toy comprising:

at least a first and a second resiliently deflectable element, each said element having a first end and a second end, with both said first ends being connected together and both said second ends being connected together, such that opposing forces, one applied proximal said first ends and another applied proximal said second ends, urge said first ends toward said second ends serving to deflect said first and second deflectable elements such that the portions of said first and second deflectable elements intermediate said first ends and said second ends are deflected away from one another; and at least a first and a second tendon, each having a first end and a second end with said first end of said second tendon being connected to said first deflectable element intermediate said first end and said second end of said first deflectable element with a portion of said second tendon including said second tendon second end, extending past said second deflectable element, and the first end of said first tendon being connected to said second deflectable element intermediate said first end and said second end of said second deflectable element with a portion of said first tendon, including said first tendon second end, extending past said first deflectable element, whereby such deflection of the deflectable elements will serve to pull first and second tendons past one another in generally opposite directions, urging the second ends of the first and second tendons toward the first and second deflectable elements.

2. A mechanism as in claim 1 incorporated within a doll comprising at least two appendages connected to said mechanism, said second end of one said tendon being operatively connected to a first one of said appendages and said second end of said other tendon being operatively connected to a second one of said appendages such that as said deflectable elements are deflected, each said tendon pulls a portion of a corresponding one of said first and second appendages generally toward said mechanism.

3. A mechanism as in claim 2 wherein said two appendages comprise a pair of opposing arms, each arm comprising a plurality of arm segments each hingedly connected to at least one adjacent arm segment.

4. A mechanism as in claim 1 wherein said at least a first and a second resiliently deflectable element further comprises a third said resiliently deflectable element, and said at least two tendons comprise at least two additional said tendons, defining a third said tendon and a fourth said tendon, said third and fourth tendons each having a first end and a second end, with each said first end being connected to said third deflectable element intermediate said first end and said second end thereof with a portion of each of said third and fourth tendons, including each said second end, extending past said first and second deflectable elements, whereby deflection of the deflectable elements will serve to pull the second ends of said third and fourth tendons toward the deflectable elements.

5. A mechanism as in claim 4 incorporated within a doll having at least four appendages, including a third appendage and a fourth appendage, connected to said mechanism, said second end of said third tendon being operatively connected to said third appendage and said second end of said fourth tendon being operatively connected to said fourth appendage such that each said tendon pulls a portion of said appendage attached thereto generally toward said mechanism as said third deflectable element is deflected.

6. A mechanism as in claim 5 wherein said third and fourth appendages comprise a pair of adjacent legs, each leg comprising a plurality of sections each hingedly connected to at least one adjacent section.

7. A mechanism as in claim 5 wherein said doll further comprises at least one additional appendage of said at least four appendages defining a fifth appendage having a first end and a second end said first end being connected to said mechanism, and one additional said tendon defining a fifth tendon having a first end and a second end, said first end of said fifth tendon being connected to said third deflectable element intermediate said first end and said second end thereof with a portion of said fifth tendon, including said second end, extending past said first and second deflectable elements, said second end of said fifth tendon being operatively connected to said second end of said fifth appendage.

8. A mechanism as in claim 7 wherein said fifth appendage comprises a tail, said tail comprising a plurality of parts each hingedly connected to at least one adjacent part.

9. A mechanism as in claim 1 wherein said at least a first and a second resiliently deflectable element further comprise a third resiliently deflectable element, and said at least two tendons comprise two additional tendons, defining a sixth and a seventh tendon, said sixth and said seventh tendons each having a first end and a second end, with said first ends being connected to said third deflectable element intermediate said first end and said second end of said third deflectable element with said second ends of said sixth and said seventh tendons extending away from said first and second deflectable elements, whereby deflection of said third deflectable element will serve to urge said second end of said sixth tendon and said second end of said seventh tendon away from said first and second deflectable elements.

10. A mechanism as in claim 9 incorporated within a doll having a pair of openings therein, said second ends of said sixth tendon and said seventh tendon being operatively mounted within a respective said opening for movement within said opening as said third deflectable element is deflected.

11. A mechanism as in claim 1 wherein said at least a first and a second resiliently deflectable element further comprise a third and a fourth resiliently deflectable element, and said at least two tendons comprise at least two additional tendons, defining a third and a fourth tendon, said third and fourth tendons each having a first end and a second end, with said first ends being connected to said third deflectable element intermediate said first end and said second end of said third deflectable element said second ends of said third and said fourth tendons extend away from said third and fourth deflectable elements.

12. A mechanism as in claim 11 incorporated within a doll comprising at least two appendages, defining a third appendage and a fourth appendage, connected to said mechanism, said second end of said third tendon being operatively connected to said third appendage and said second end of said fourth tendon being operatively connected to said fourth appendage such that each respective said tendon pulls a portion of a corresponding one of said third and fourth appendages generally toward said mechanism and said third and fourth tendons relax as said third and fourth deflectable elements are deflected causing a portion of a corresponding one of said third and fourth appendages to move away from said third and fourth deflectable elements.

13. A mechanism as in claim 1 further comprising a front compression plate having an inward side and an outward side, said first ends of each deflectable element being hingedly attached to said inward side of said front compression plate, and a back compression plate having an inward side and an outward side, said second ends of each deflectable element being hingedly attached to said inward side of said back compression plate, whereby two opposing forces, one applied to said outward side of said front compression plate and one applied to said outward side of said back compression plate, deflect said deflectable elements.

14. A mechanism as in claim 13 incorporated within a doll having a body, further comprising at least two stabilizing means each comprising a tube having a first open end and a second end, said tube being attached to said body of said doll such that said second end extends inwardly of said body of said doll and said open end faces outwardly of said body; and a post having a first end and a second end, said first end of said post being attached to one of said compression plates and said second end of said post being received by said second end of said tube, one said stabilizing means connecting said front compression plate with said body and the other said stabilizing means connecting said rear compression plate with said body.

15. A mechanism as in claim 1 wherein each said deflectable element comprises a first part including said first end thereof and a second part including said second end thereof and each said deflectable element further comprises hinge means inserted between and attached to said respective first parts and second parts.

16. A mechanism as in claim 1 further comprising at least one biasing means connected to said deflectable elements such that each said intermediate portion of said deflectable elements are urged toward one another.

* * * * *

UNITED STATES PATENT AND TRADEMARK OFFICE

CERTIFICATE OF CORRECTION

PATENT NO. : 5,378,188

DATED : January 3, 1995

INVENTOR(S) : Dolores H. Clark

It is certified that error appears in the above-identified patent and that said Letters Patent is hereby corrected as shown below:

Column 8, line 4, after "element" insert --while--.

Signed and Sealed this

Twenty-first Day of March, 1995

*Attest:*

Bruce Lehman

BRUCE LEHMAN

*Attesting Officer*

*Commissioner of Patents and Trademarks*